US005685473A

United States Patent [19]

Shkolnikov et al.

[11] Patent Number: 5,685,473

[45] Date of Patent: Nov. 11, 1997

[54] FASTENER-DRIVING TOOL HAVING ADJUSTABLE CONTROLLING MECHANISM

[75] Inventors: Yury Shkolnikov, Glenview; Donald L. Van Erden, Wildwood; Scott A. Howell, Crystal Lake, all of Ill.

[73] Assignee: Illinois Tool Works Inc., Glenview, Ill.

[21] Appl. No.: 660,114

[22] Filed: Jun. 7, 1996

[51] Int. Cl.[6] ..... B25C 1/04

[52] U.S. Cl. ..... 227/8; 227/142

[58] Field of Search ..... 227/8, 142

[56] References Cited

U.S. PATENT DOCUMENTS

| | | | |
|---|---|---|---|
| 3,056,965 | 10/1962 | Rogers | 1/106 |
| 3,172,124 | 3/1965 | Kremiller | 227/8 |
| 3,519,186 | 7/1970 | Volkmann | 227/8 |
| 3,854,648 | 12/1974 | Inzoli et al. | 227/136 |
| 4,053,093 | 10/1977 | Thuerringer | 227/5 |
| 4,384,668 | 5/1983 | Tutomu et al. | 227/8 |
| 4,434,643 | 3/1984 | Wandel | 227/130 |
| 4,767,043 | 8/1988 | Canlas, Jr. | 227/8 |
| 4,821,937 | 4/1989 | Rafferty | 227/8 |
| 5,219,110 | 6/1993 | Mukoyama | 227/142 |
| 5,261,587 | 11/1993 | Robinson | 227/8 |
| 5,385,286 | 1/1995 | Johnson, Jr. | 227/8 |
| 5,564,614 | 10/1996 | Yang | 227/142 |

*Primary Examiner*—Scott A. Smith

*Attorney, Agent, or Firm*—Mark W. Croll; Thomas W. Buckman; John P. O'Brien

[57] ABSTRACT

An improved mechanism for controlling a fastener-driving tool comprises a workpiece-contacting element, a tool-controlling element movable conjointly with the workpiece-contacting element over a limited range, a spool defining having a threaded connection with the workpiece-contacting element and a swivel connection with the tool-controlling element and having axial ribs alternating with axial ribs, and a spool-restraining element movable along a radial line between a spool-restraining position and a spool-releasing position and biased toward the spool-restraining position. The spool-restraining member is arranged to restrain the spool against rotating at the swivel and threaded connections by projecting into any given one of the grooves, between the fibs nearest to the given one of the grooves, when the workpiece-contacting element is moved inwardly from an outer portion of the limited range but not when the workpiece-contacting element is within the outer portion of the limited range.

8 Claims, 3 Drawing Sheets

FASTENER-DRIVING TOOL HAVING ADJUSTABLE CONTROLLING MECHANISM

TECHNICAL FIELD OF THE INVENTION

This invention pertains to an improved, adjustable mechanism for controlling a fastener-driving tool, whereby the depth-of-drive can be adjusted.

BACKGROUND OF THE INVENTION

Conventionally, a fastener-driving tool, whether pneumatically powered or combustion-powered, has a nosepiece, through which fasteners are driven into workpieces, and is equipped with a tool-controlling mechanism including a workpiece-contacting element, which is movable inwardly toward the nosepiece and outwardly from the nosepiece. The tool-controlling mechanism may include a tool-controlling element, which is movable conjointly with the workpiece-contacting element over a limited range, the conjointly movable elements being biased outwardly toward an outer portion of the limited range. The tool-controlling mechanism is operative for controlling the tool so that the tool is enabled when the workpiece-contacting element contacts and is pressed firmly against a workpiece until the tool-controlling element inwardly to an inner portion of the limited range and so that the tool is disabled when the workpiece-contacting element is removed from the workpiece and is moved outwardly as biased from the inner portion of the limited range.

As exemplified in Volkmann U.S. Pat. No. 3,519,186, Canlas, Jr., U.S. Pat. No. 4,767,043, Mukoyama U.S. Pat. No. 5,219,110, and Johnson, Jr., U.S. Pat. No. 5,385,286, it is known for the tool-controlling mechanism of a fastener-driving tool to be adjustable so as to permit the depth-of-drive to be adjusted. Herein, the depth-of-drive refers to the depth to which a fastener, such as a nail, can be driven by the fastener-driving tool. Generally, the tool-controlling mechanism may be adjusted so that the fastener may stand off the workpiece surface or so that the fastener may be countersunk below a workpiece surface.

This invention has resulted from efforts to improve the tool-controlling mechanism of a fastener-driving tool, particularly a tool-controlling mechanism including a workpiece-contacting element and a tool-controlling element, as discussed above.

SUMMARY OF THE INVENTION

Broadly, this invention provides an improvement in a fastener-driving tool having a nosepiece and being equipped with a tool-controlling means, which includes a workpiece-contacting element movable inwardly toward the nosepiece and outwardly from the nosepiece over a limited range and which includes a tool-controlling element movable conjointly with the workpiece-contacting element. The conjointly movable elements are biased outwardly toward an outer portion of the limited range. The tool-controlling means is used for controlling the tool so that the tool is enabled when the workpiece-contacting element contacts and is pressed firmly against a workpiece until the tool-controlling element is moved inwardly to an inner portion of the limited range and so that the tool is disabled when the workpiece-contacting element is removed from the workpiece and is moved outwardly as biased from the inner portion of the limited range.

According to this invention, the tool-controlling means further comprises a spool and a spool-restraining element.

The spool, which defines an axis, connects the tool-controlling element to the workpiece-contacting element, at a swivel connection between the spool and a selected one of the tool-controlling and workpiece-contacting elements and at a threaded connection between the spool and the remaining one of the tool-controlling and workpiece-contacting elements. The spool-restraining element, which is movable between a spool-restraining position and a spool-releasing position and which is biased toward the spool-restraining position, is arranged to restrain the spool against rotating at the swivel and threaded connections by engaging the spool when the workpiece-contacting element is moved inwardly from the outer portion of the limited range but not when the work-piece contacting element is within the outer portion of the limited range. Preferably, the spool connects the tool-controlling element to the workpiece-contacting element, at a swivel connection between the spool and the tool-controlling element and at a threaded connection between the spool and the workpiece-contacting element.

Preferably, the spool has a circumferentially spaced array of axial ribs alternating with axial grooves, and the spool-restraining element is movable between the spool-restraining position and the spool-releasing position, along a line intersecting the axis defined by the spool approximately at a right angle. Preferably, moreover, the spool-restraining element is arranged to restrain the spool against rotating at the swivel and threaded connections projecting into any given one of the grooves, between the ribs nearest to the given one of the grooves, when the workpiece-contacting element is moved inwardly from the outer portion of the limited range but not when the workpiece-contacting element is within the outer portion of the limited range.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
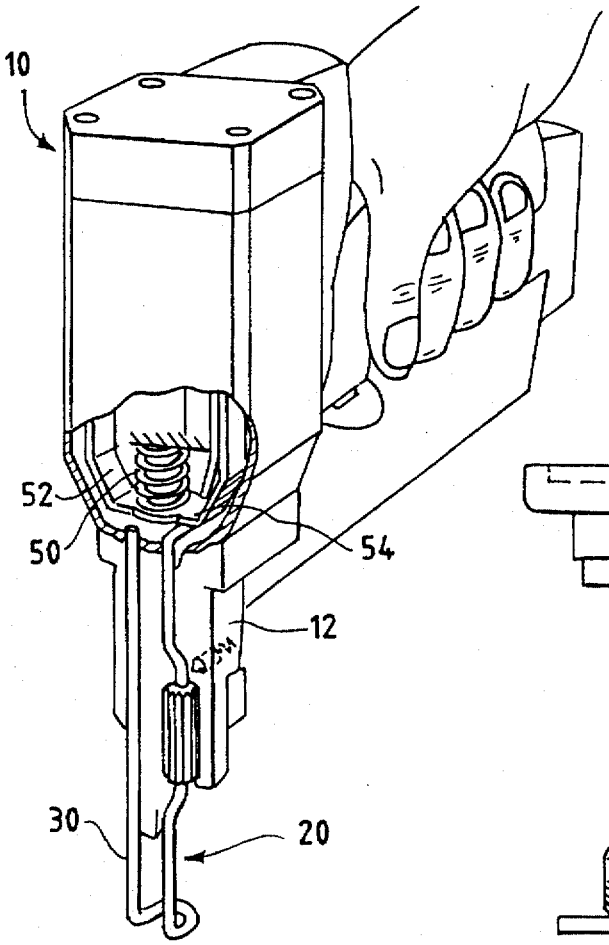
FIG. 1 is a partly broken away, perspective view of a fastener-driving tool, which is equipped with a tool-controlling mechanism according to this invention.

As shown in FIG. 1, a fastener-driving tool 10 having a nosepiece 12, through which nails or other fasteners are driven into a workpiece, is equipped with a tool-controlling mechanism 20 constituting a preferred embodiment of this invention. The tool-controlling mechanism 20 is adjustable, in a manner described below, so as to permit the depth-of-drive to be adjusted, i.e. the depth to which a fastener, such as a nail, can be driven by the fastener-driving tool 10.

As shown, the tool 10 is a pneumatically powered, nail-driving tool. A tool-controlling mechanism similar to the mechanism 20 would be also useful in a fastener-driving tool of a different type, such as a pneumatically powered, staple-driving tool, a combustion-powered, nail-driving tool, or a combustion-powered, staple-driving tool.

Broadly, the a tool-controlling mechanism 20 includes a workpiece-contacting element 30, which is movable inwardly (upwardly as shown) toward the nosepiece 12 and outwardly (downwardly as shown) from the nosepiece 12 over a limited range, and a tool-controlling element 40, which is movable conjointly with the workpiece-contacting element 30. The workpiece-contacting element 30 has a longer leg 32, a looped foot 34, and a shorter leg 36, which has a threaded end 38. The looped foot 34 joins the longer leg 32 and the shorter leg 36. The tool-controlling element 40 has a hooked end 42 and a grooved end 44, which has an annular groove 46. The conjointly movable elements 30, 40, are biased outwardly (downwardly as shown) toward an outer portion of the limited range, by a compression spring 50 bearing against a movable bracket 52, which is attached to the hooked end 42 of the tool-controlling element 40, as by a rivet 54.

The tool-controlling mechanism 20, which includes the compression spring 50 and the movable bracket 52, is used for controlling the tool 10 in a known manner, which is outside the scope of this invention, so that the tool 10 is enabled when the workpiece-contacting element 30 contacts and is pressed firmly against a workpiece W (see FIGS. 2, 5, 6, and 7) until the tool-controlling element 40 is moved inwardly (upwardly as shown) to an inner portion of the limited range and so that the tool 10 is disabled when the workpiece-contacting element 30 is removed from the workpiece W and is moved outwardly (downwardly as shown) as biased from the inner portion of the limited range.

According to this invention, the tool-controlling mechanism 20 further comprises a spool 60 and a spool-restraining element 90. The spool 60, which defines an axis, connects the tool-controlling element 40 to the workpiece-contacting element 30, at a swivel connection 62 between the spool 60 and grooved end 44 of the tool-controlling element and at a threaded connection 64 between the spool 60 and the workpiece-contacting element 30. The spool 60 has a central bore 70 having a grooved end 72, which has an annular groove 74, into which the grooved end 44 of the tool-controlling element 40 is inserted, and in which the grooved end 44 is retained by a polymeric ring 100 disposed within the annular groove 46 of the grooved end 44 and within the annular groove 74, and a threaded end 76, into which the threaded end 38 of the workpiece-contacting element 30 is threaded to an adjustable depth. The spool 60 has a circumferential array of axial ribs 78 alternating with axial grooves 80. The spool 60 is disposed so that some of the ribs 78 are accessible to a finger of a user for rotating the spool 60 so as to vary the depth of threading of the threaded end 38 of the workpiece-contacting element 30 into the threaded end 76 of the central bore 70 of the spool 60.

The spool-restraining element 90, which has a flat, inner end 92 and a frusto-conical, outer end 94, is mounted within a socket 96 in the nosepiece 12 so as to be linearly movable between a spool-restraining position and a spool-releasing position, along a line intersecting the axis defined by the spool 60 approximately at a right angle. The spool-restraining element 90 is biased toward the spool-restraining position by a coiled spring 98 (see FIG. 6) compressed between the inner end 92 and a retainer 110 mounted within the socket 96. The spool-restraining element 90 is arranged to restrain the spool 60 against rotating at the swivel connection 62 and at the threaded connection 64 when the workpiece-contacting element 30 is moved inwardly from the outer portion of the limited range but not when the workpiece-contacting element 30 is within the outer portion of the limited range.

Figure 4:
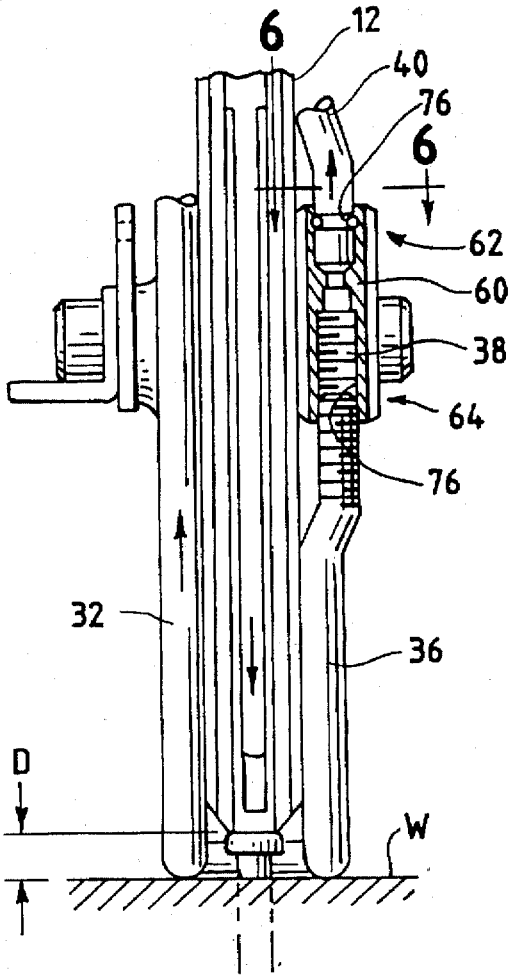
FIGS. 4 and 5 are views derived similarly from FIG. 2, showing the tool-controlling mechanism in a tool-enabling position, and showing the tool-controlling mechanism as adjusted respectively so that a driven fastener may stand off the workpiece surface, as shown in FIG. 4 and so that a driven fastener may be generally flush with a workpiece surface, as shown in FIG. 5.

As shown in FIG. 4, if the spool 60 is rotated so that the threaded end 38 of the workpiece-contacting element 30 is threaded fully into the threaded end 76 of the central bore 70 of the spool 60, the nosepiece 12 remains spaced by a distance D from the workpiece W when the fastener-driving tool 10 is enabled, i.e. when the looped foot 34 of the workpiece-contacting element 30 is pressed firmly against the workpiece W until the tool-controlling element 40 is moved inwardly (upwardly as shown) to an inner portion of the limited range of conjoint movement of the conjointly movable elements 30, 40. Thus, when the fastener-driving tool 10 is operated to drive a fastener, such as the nail N shown in broken lines, into the workpiece W, the fastener is driven so as to stand off the workpiece surface by the same distance D.

Figure 5:
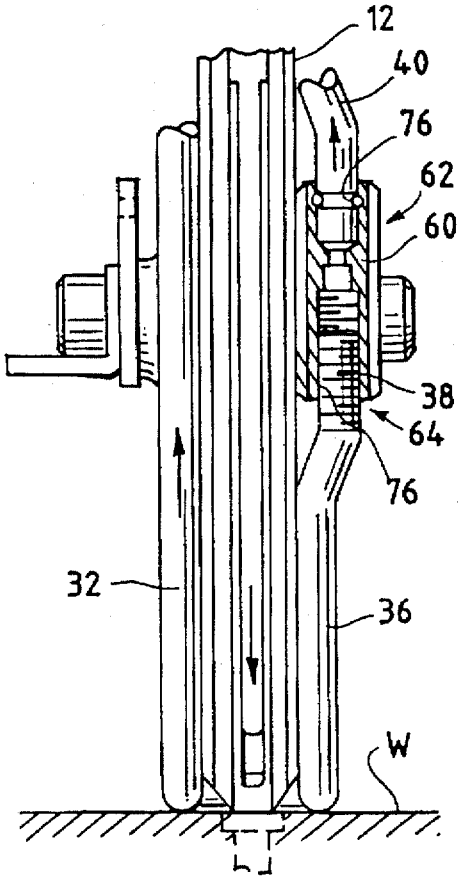

As shown in FIG. 5, if the spool 60 is rotated so that the threaded end 38 of the workpiece-contacting element 30 is threaded partially and by a suitable distance into the threaded end 76 of the central bore 70 of the spool 60, the nosepiece 12 contacts the workpiece W when the fastener-driving tool 10 is enabled. Thus, when the fastener-driving tool 10 is operated to drive a fastener, such as the nail N shown in broken lines, into the workpiece W, the fastener is driven so as to be generally flush with the workpiece surface. Likewise, if the spool 60 is rotated so that the threaded end 38 of the workpiece-contacting element 30 is threaded further but not fully into the threaded end 76 of the central bore 70 of the spool 60, a fastener, such as the nail N, can be driven into the workpiece W so as to stand off the workpiece surface by a distance less than the distance D indicated in FIG. 4.

Figure 2:
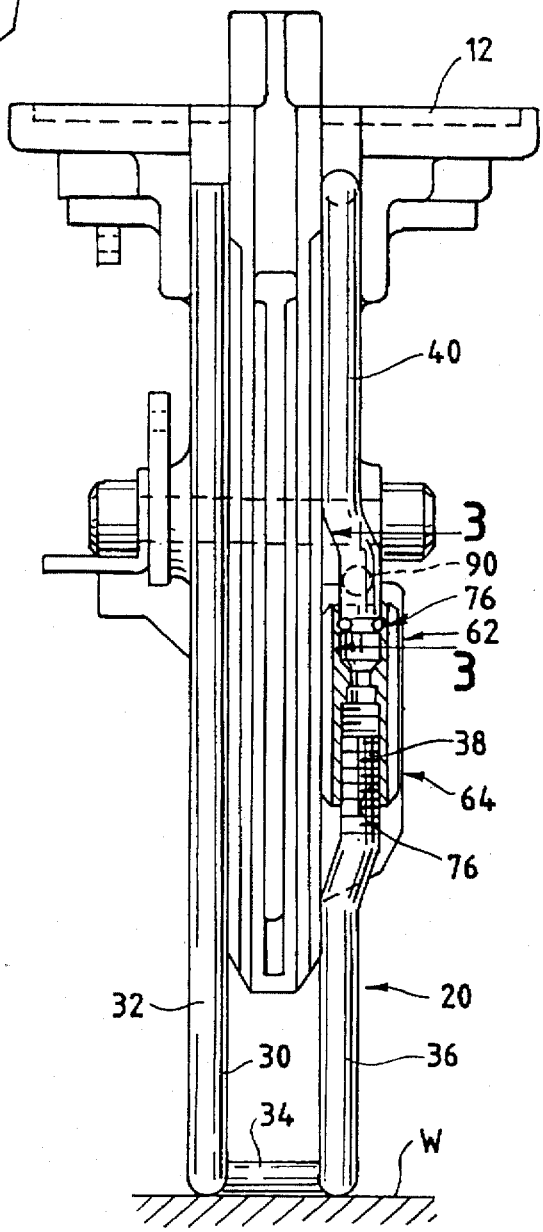
FIG. 2 is a fragmentary, partly sectioned, elevational view of the tool-controlling mechanism and a nosepiece of the fastener-driving tool. The tool-controlling mechanism is shown in a tool-disabling position with a workpiece-contacting element contacting a workpiece.
Figure 3:
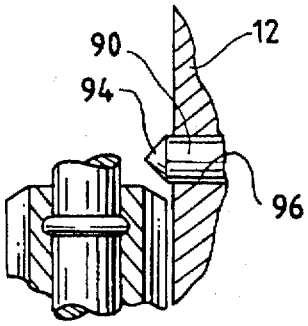
FIG. 3 is a fragmentary, sectional view taken along line 3—3 of FIG. 2, in a direction indicated by arrows.

As shown in FIG. 2, when the conjointly movable elements 30, 40, are in an outer portion of the limited range of conjoint movement of such elements 30, 40, the spool-restraining element 90 is inward of the spool 60 and does not engage the spool 60, which can rotate at the swivel connection 62 and at the threaded connection 64 without interference with the spool-restraining element 90. Thus, when the fastener-driving tool 10 is in a toolbox or on a workbench, the depth-of-drive can be easily adjusted by rotating the spool 60 relative to the conjointly movable elements 30, 40, without interference therewith. The ribs 78 facilitate rotating the spool 60 relative thereto.

Figure 6:
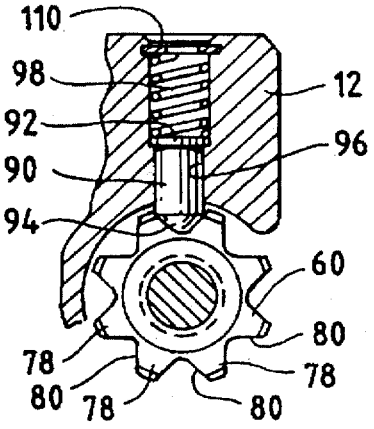
FIG. 6 is a fragmentary, sectional view taken along line 6—6 of FIG. 4, in a direction indicated by arrows.
Figure 7:
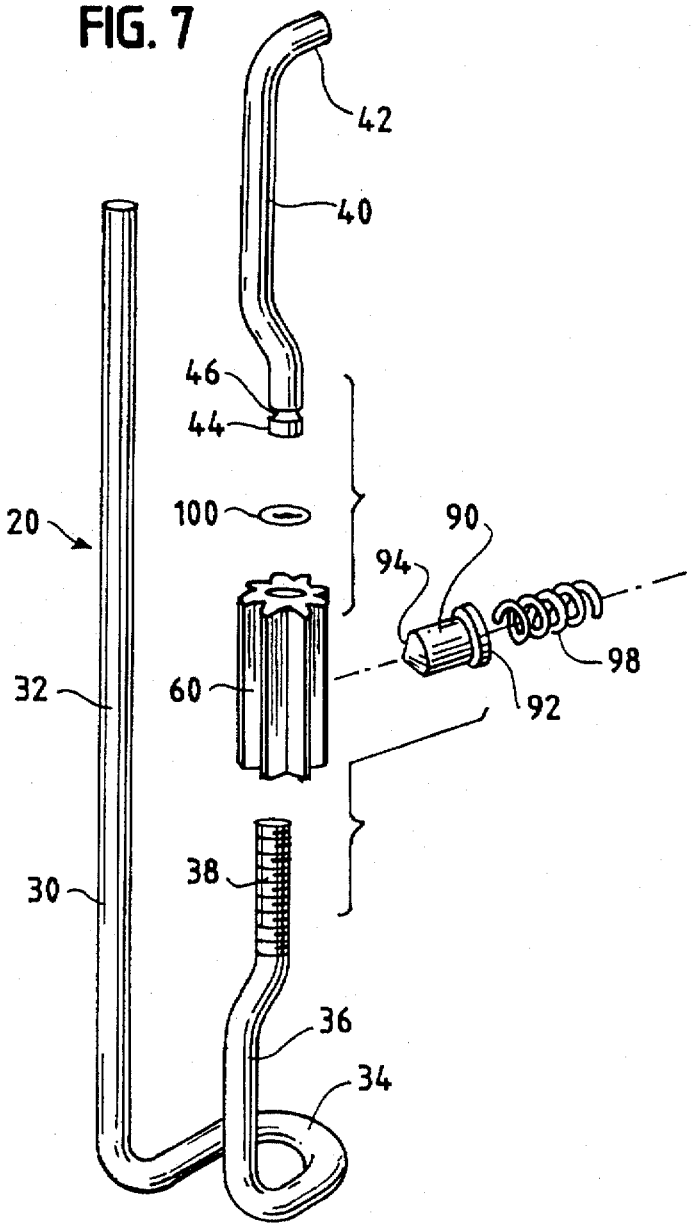
FIG. 7 is an exploded, perspective view of some of the elements of the tool-controlling mechanism.
Figure 8:
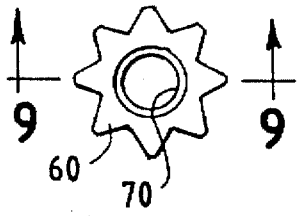
FIG. 8, on an enlarged scale, is an upper end view of a spool, which is one of the elements of the tool-controlling mechanism.
Figure 9:
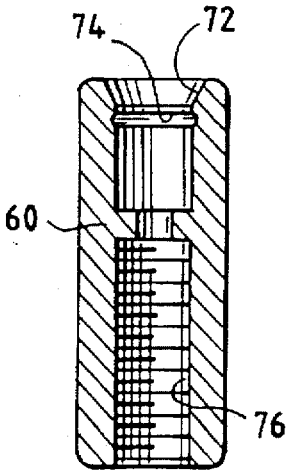
FIG. 9 is a sectional view taken along line 9—9 of FIG. 8, in a direction indicated by arrows.
Figure 10:
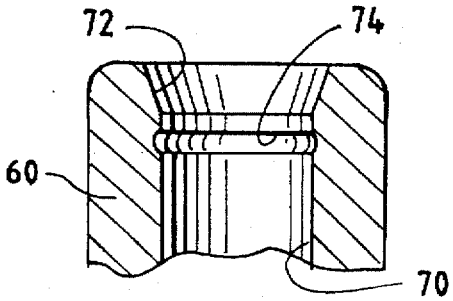
FIG. 10 is an enlargement of an upper portion of the spool, as shown in FIG. 9.

As shown in FIGS. 4, 5, and 6, when the looped foot 34 of the workpiece-contacting element 30 is pressed firmly against the workpiece W until the conjointly movable elements 30, 40, are moved inwardly (upwardly as shown) from the outer portion of the limited range of conjoint movement of such elements 30, 40, the spool-restraining element 90 projects into a given one of the grooves 80, between the ribs 78 nearest to the given one of the ribs 80.

Thus, when the fastener-driving tool 10 is operated, the spool-restraining element 90 restrains the spool 60 against rotating. However, the spool 90 may exhibit a very small rotation, if and as required to center the spool-restraining element 90 between the ribs 78 nearest to the given one of the grooves 80. Although the spool 60 is restrained against rotating, the spool 60 could be forcibly rotated, whereupon the coiled spring 98 biasing the spool-restraining element 90 would be compressed as the spool-restraining element 90 would be cammed over each rib 80 passing by the spool-restraining element 90.

Various modifications could be made in the preferred embodiment without departing from the scope and spirit of this invention.

We claim:

1. In a fastener-driving tool having a nosepiece and being equipped with a tool-controlling means including a workpiece-contacting element movable inwardly toward the nosepiece and outwardly from the nosepiece over a limited range and a tool-controlling element movable conjointly with the workpiece-contacting element, the conjointly movable elements being biased outwardly toward an outer portion of the limited range, for controlling the tool so that the tool is enabled when the workpiece-contacting element contacts and is pressed firmly against a workpiece until the tool-controlling element inwardly to an inner portion of the limited range and so that the tool is disabled when the workpiece-contacting element is removed from the workpiece and is moved outwardly as biased from the inner portion of the limited range, an improvement wherein the tool-controlling means further comprises a spool defining an axis and connecting the tool-controlling element to the workpiece-contacting element, at a swivel connection between the spool and a selected one of the tool-controlling and workpiece-contacting elements and at a threaded connection between the spool and the remaining one of the tool-controlling and workpiece-contacting elements, and a spool-restraining element movable between a spool-restraining position and a spool-releasing position, biased toward the spool-restraining position, and arranged to restrain the spool against rotating at the swivel and threaded connections by engaging the spool when the workpiece-contacting element is moved inwardly from the outer portion of the limited range but not when the workpiece-contacting element is within the outer portion of the limited range.

2. The improvement of claim 1 wherein the spool has a circumferentially spaced array of axial ribs alternating with axial grooves, and wherein the spool-restraining element is arranged to restrain the spool by projecting into any given one of the grooves, between the ribs nearest to the given one of the grooves.

3. The improvement of claim 1 wherein the spool-restraining element is movable along a line intersecting the axis defined by the spool.

4. The improvement of claim 2 wherein the spool-restraining element is movable along a line intersecting the axis defined by the spool.

5. In a fastener-driving tool having a nosepiece and being equipped with a tool-controlling means including a workpiece-contacting element movable inwardly toward the nosepiece and outwardly from the nosepiece over a limited range and a tool-controlling element movable conjointly with the workpiece-contacting element, the conjointly movable elements being biased outwardly toward an outer portion of the limited range, for controlling the tool so that the tool is enabled when the workpiece-contacting element contacts and is pressed firmly against a workpiece until the tool-controlling element inwardly to an inner portion of the limited range and so that the tool is disabled when the workpiece-contacting element is removed from the workpiece and is moved outwardly as biased from the inner portion of the limited range, an improvement wherein the tool-controlling means further comprises a spool defining an axis and connecting the tool-controlling element to the workpiece-contacting element, at a swivel connection between the spool and the tool-controlling element and at a threaded connection between the spool and the workpiece-contacting element, the spool having a circumferentially spaced array of axial ribs alternating with axial grooves, and a spool-restraining element movable between a spool-restraining position and a spool-releasing position, along a line intersecting the axis defined by the spool approximately at a right angle, biased toward the spool-restraining position, and arranged to restrain the spool against rotating at the swivel and threaded connections by projecting into any given one of the grooves, between the ribs nearest to the given one of the grooves, when the workpiece-contacting element is moved inwardly from the outer portion of the limited range but not when the workpiece-contacting element is within the outer portion of the limited range.

6. For controlling a fastener-driving tool, a mechanism comprising a workpiece-contacting element, a tool-controlling element movable conjointly with the workpiece-contacting element over a limited range, a spool having a threaded connection with the workpiece-contacting element and a swivel connection with the tool-controlling element, and means including a spool-restraining element movable along a radial line between a spool-restraining position and a spool-releasing position and biased toward the spool-restraining position for restraining the spool against rotating at the swivel and threaded connections by engaging the spool when the workpiece-contacting element is moved inwardly from an outer portion of the limited range but not when the workpiece-contacting element is within the outer portion of the limited range.

7. The mechanism of claim 6 wherein the spool has axial ribs alternating with axial ribs and wherein the spool-restraining element is arranged to restrain the spool by projecting into any given one of the grooves, between the ribs nearest to the given one of the grooves.

8. The improvement of claim 7 wherein the spool-restraining element is movable along a line intersecting an axis defined by the spool approximately at a right angle.

* * * * *